US005489766A

United States Patent [19]

Walters et al.

[11] Patent Number: 5,489,766

[45] Date of Patent: Feb. 6, 1996

[54] FOOD BAG FOR MICROWAVE COOKING WITH FUSED SUSCEPTOR

[75] Inventors: Glenn J. Walters, Duxbury; John A. McCormick, Lakeville, both of Mass.

[73] Assignee: Advanced Deposition Technologies, Inc., Taunton, Mass.

[21] Appl. No.: 327,647

[22] Filed: Oct. 24, 1994

[51] Int. Cl.[6] ..... H05B 6/80; B65D 81/34

[52] U.S. Cl. ..... 219/730; 219/727; 426/107; 426/234

[58] Field of Search ..... 219/728, 730, 219/759, 727; 99/DIG. 14; 426/107, 109, 234, 241, 243

[56] References Cited

U.S. PATENT DOCUMENTS

| | | | |
|---|---|---|---|
| 4,320,274 | 3/1982 | Dehn | 219/728 |
| 5,079,397 | 1/1992 | Keefer | 219/728 |
| 5,223,288 | 6/1993 | Mendenhall et al. | 426/107 |
| 5,278,378 | 1/1994 | Beckett | 219/728 |
| 5,354,973 | 10/1994 | Beckett | 219/730 |
| 5,412,187 | 5/1995 | Walters et al. | 219/730 |

*Primary Examiner*—Philip H. Leung
*Attorney, Agent, or Firm*—Wolf, Greenfield & Sacks

[57] ABSTRACT

A bag for heating food products in a microwave oven and a blank for forming the bag are disclosed. The bag is formed of a dielectric substrate having a laminated layer including at least one microwave interactive patch. The microwave interactive patches are positioned to avoid overheating at creases and seams formed in the bag. At least one of the microwave interactive patches includes a heat sensitive fuse.

33 Claims, 2 Drawing Sheets

FOOD BAG FOR MICROWAVE COOKING WITH FUSED SUSCEPTOR

FIELD OF INVENTION

The present invention is in the field of flexible, active microwave packages which hold foodstuffs and improve the cooking, heating or browning of such foodstuffs when exposed to microwave energy within the flexible package. More particularly, the invention is related to those flexible bags and pouches having elements which interact with the electromagnetic energy generated by a microwave oven to heat, crisp and brown foodstuffs contained therein.

BACKGROUND

The field of active flexible microwave packaging includes numerous attempts to optimize a package for popping corn in a microwave oven. Many of the early United States patents in the field of packaging for microwaveable food products, (U.S. Pat. No. 4,219,573 to Borek, U.S. Pat. Nos. 4,553,010 and 4,678,882 to Bohrer, and U.S. Pat. Nos. 4,735,513 and 4,878,765 to Watkins) describe microwaveable popcorn bags incorporating a susceptor patch.

In each case, the bag is loaded with a portion of popping corn and oil, and that portion is positioned over the susceptor patch. The size of the patch is limited by the desire to eliminate scorching and overheating of the bag which occurs when the patch is of a size greater than the food load positioned adjacent to the susceptor.

Another active microwave package (not designed specially for popcorn) is described in U.S. Pat. No. 4,890,439 to Smart. The Smart patent suggests the use of a package having multiple susceptor patches as well as the requirement to eliminate the susceptor from the seal areas of the package in order to prevent the bag from unsealing during microwave heating. The Smart patent also seeks to prevent the seal itself from disintegrating.

Canadian patent application 2,033,775 to Mason et al describes a microwave cooking bag defining an enclosed cooking space substantially surrounded by a susceptor material. More particularly, Mason et al. teach excluding susceptor material from the fin seal area of a bag and further teach excluding susceptor material in an area in the proximity of the open end of the bag. The reference also suggests varying the area of the susceptor surface for different heating performance.

The intensity of the microwave field within a microwave oven is a significant problem for flexible packaging having microwave interactive elements. These interactive elements heat quickly and significantly when irradiated with microwave energy, especially in susceptor areas not in contact with a food product, since the food product acts as a heat sink and a microwave shield. The resulting intense heating has, in the prior art, limited positioning of the susceptor to areas that approximate the size of the food load. This has inhibited commercialization of a general purpose active microwave bag for retail consumer applications.

Scorching, burning and unwanted sealing can occur when two or more microwave active layers come in close proximity to one another. For instance, wherever two surfaces of a heat-sealable susceptor laminate are heat-sealed to form a bag, the seal areas, when exposed to microwave energy get extremely hot, perhaps even hot enough to cause damage to the package. (In fact numerous cases have been documented in which conventional susceptor-containing packages have caught fire in consumer microwave ovens.)

The fused susceptor described in application Ser. No. 08/187,446 U.S. Pat. No. 5,412,187 entitled FUSED MICROWAVE CONDUCTIVE STRUCTURE and incorporated herein by reference provides a system of increasing the susceptor area of a package without increasing the risk of burning and scorching of the package in unloaded or non-shielded areas.

SUMMARY AND OBJECTS OF THE INVENTION

The present invention relates to a general purpose flexible, active microwave bag having microwave interactive regions that are strategically sized, shaped and located to provide desired browning and crisping performance for a broad variety of foodstuffs. The microwave interactive regions form microwave susceptors which are configured to eliminate unwanted sealing, discoloration, scorching and burning that has been seen in prior art general purpose active microwave bags.

The invention overcomes undesirable aspects of conventional microwave cooking bags while offering versatility in the selection of the food product to be cooked. For example, if a food product such as a frozen filled pastry is heated in a conventional microwave popcorn bag (a two ply construction of paper with a microwave susceptor positioned therebetween) with the pastry at the center of the susceptor, upon microwaving, the base of the pastry will become crisp and brown as desired, but the top will not brown and, in some areas, will not cook at all. 0n the other hand, if the same product is exposed to microwave energy while positioned in a flat tube style 100% susceptor bag (i.e., a bag formed from a paper layer laminated to a heat-sealable polyethylene terephthalate (PET) susceptor film with the metal susceptor layer positioned between the paper and the PET film), several problems immediately become evident. These include failure of the bag to expand, discoloration, scorching and occasional burning of the outer paper.

One object of the present invention is to provide a general purpose flexible, active microwave bag with a large microwave interactive area enabling a single bag design to heat a variety of food products.

A further object is to provide a flexible, active microwaveable bag which does not seal, scorch or burn when employed to heat or cook a 'small' load microwaveable food product.

Another object of the present invention is to provide a two-ply roll stock laminate from which general purpose active microwave bags can be formed and filled in a high speed form fill and seal machine.

DETAILED DESCRIPTION

Figure 1:
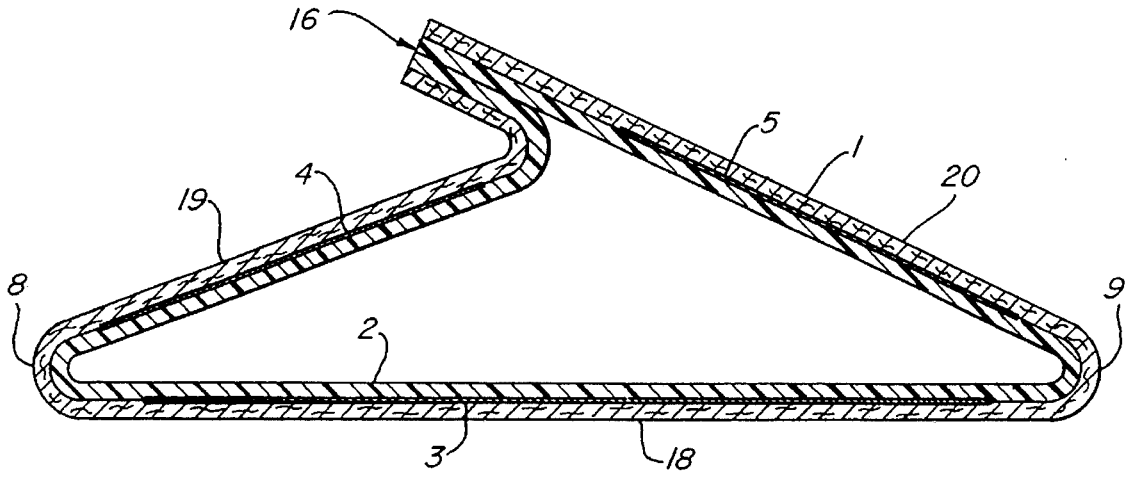
FIG. 1 is a cross-sectional view of one embodiment of the microwave bag of the present invention.

One preferred embodiment of the present invention is a flat tube style microwave bag, a cross-section of which is shown in FIG. 1. The bag has a laminated structure formed from a layer of a dielectric material such as paper 1, and a heat-sealable polymeric film 2 having thin, patterned, metallic microwave interactive layers (layers 3, 4, 5) sandwiched between the paper and the heat-sealable polymeric film. The bag has a top fin-seal 16, a base surface 18, a first top surface 19 (shown to the left of the fin-seal in FIG. 1) and a second top surface 20 (shown to the right of the fin-seal in FIG. 1).

Three distinct metallic microwave interactive patches 3, 4, 5 are provided between the paper layer 1 and the polymeric film 2. Each of the microwave interactive patches can be considered to be a microwave susceptor which heats when exposed to microwave energy. A base microwave interactive patch 3 is positioned in the base of the bag, and first 4 and second 5 top microwave interactive patches are positioned in the first 19 and second 20 surfaces of the bag, respectively. Each of these microwave interactive patches is smaller than the respective area of the base 18, first top 19 and second top 20 surfaces adjacent to which it is positioned.

As a result of the separate microwave interactive patches, unwanted sealing and scorching of the bag is prevented. That notwithstanding, the total microwave interactive area of the bag is greater than the susceptor area of conventional packages in which the susceptor area corresponds, at least loosely, with the footprint area (i.e., two-dimensional projection) of the food product contained within the bag. The resulting larger microwave interactive area of the present invention allows for microwave cooking and heating of a broad variety of food products.

Figure 2:
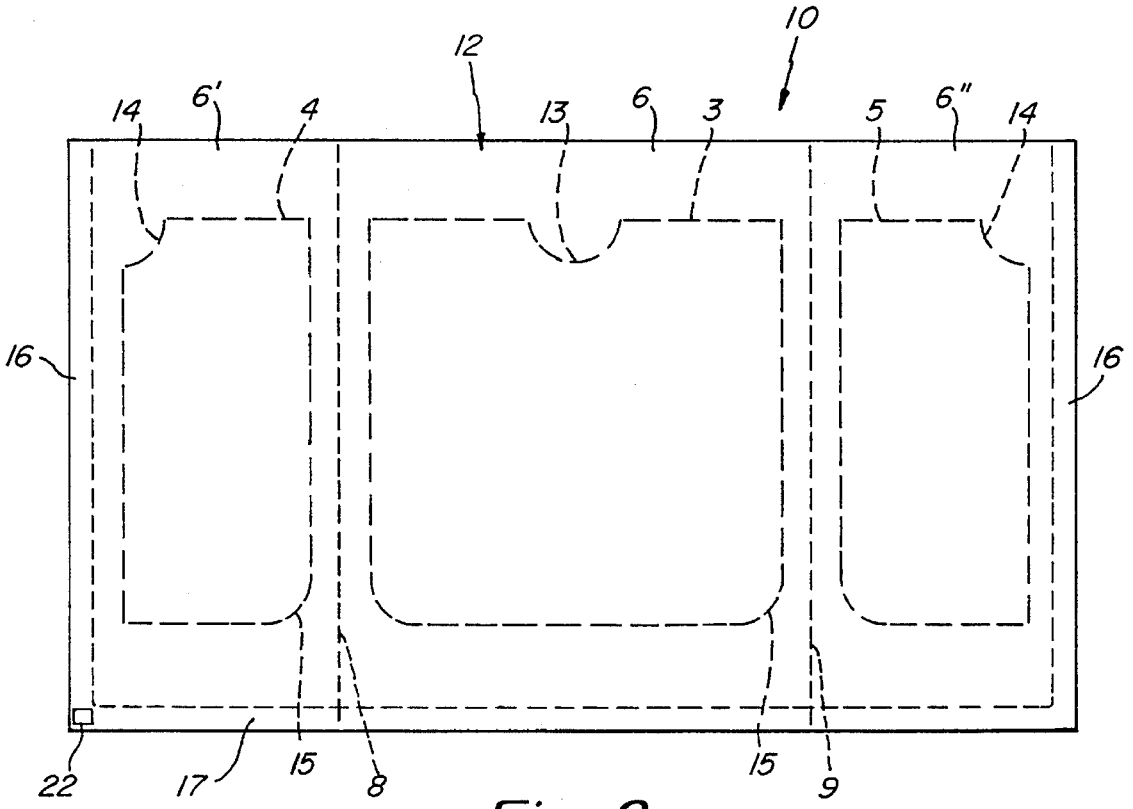
FIG. 2 is a top view of a blank used to form the microwave bag shown in FIG. 1.

FIG. 2 shows a planar perspective of a blank 10 used to form the bag shown in FIG. 1. FIG. 2 is a view of the inside surface of the blank. As shown in FIG. 2, the blank 10 has three panels, each having a fused microwave interactive panel. The panels are the center or base panel 6, the left panel 6' and the right panel 6". Microwave interactive patches 3, 4, 5 are positioned within each of panels 6, 6' and 6" respectively. The microwave interactive patches are positioned such that their periphery is surrounded by a portion of their respective panels. Thus, certain areas of the blank do not contain a microwave interactive layer. For example, it is particularly important that a microwave interactive layer is not present in the end-seal area 17 and fin-seal areas 16.

To form a bag from the blank, the end seal 17 and fin-seal 16 areas are heat-sealed together to form the end-seal and the back fin-seal of the bag, respectively. Microwave interactive material is absent from the seal areas since, if microwave interactive material were present in areas 16 and 17, the microwave interactive metallization would overlap when sealed, resulting in the possibility of scorching or burning when the bag is exposed to microwave energy. The left side of the bag and the right side of the bag are folded over the center, forming a left crease 8 and a right crease 9, which form the left and right extremities of the bag, respectively.

When a conventional bag of the type described above is used to heat a food product in a microwave oven, it is not uncommon for the bag to expand due to the generation of steam. As a result, the bag is frequently caused to buckle at one or more points in the crease areas. The buckling forces the top surface and base surface together at the location of the buckle. As a result of the heat produced by microwave interactive material present in the buckled area, the two areas often adhere to one another and prevent the bag from fully expanding. In the present invention, however, areas in the immediate vicinity of creases 8 and 9 are free of microwave interactive material. As a result, even if buckling occurs in the crease areas, the absence of microwave interactive material prevents overheating and undesired adhesion, and the bag is allowed to expand fully.

Like the fin-seal areas 16, the area near the end-seal 17 is also free of microwave interactive material, again to prevent the top surfaces (panels 6' and 6") from adhering to the base surface (panel 6) and preventing the bag from fully expanding. The blank 10 (and the bag formed therefrom) includes an open top or mouth area 18 which also lacks microwave interactive material, thereby allowing the end of the bag near the mouth 18 to be folded-over (bringing four laminate layers in close proximity to one another). In so doing, the bag may be closed without the fold layers scorching or burning. The formed bag also includes notch areas 13 and 14 which form a clip area (free of microwave interactive material) to allow the use of a plastic clip to seal the folded bag without the plastic clip coming into contact with a microwave interactive area of the bag and possibly melting.

The crease 8, 9 and the end seal 17 meet at corners of the formed bag. In the corner areas, the top and bottom surfaces of the blank are held together by two elements, the end seal and the crease. Near the corners, the microwave interactive patches have radiused corners 15 to increase the distance between each respective microwave interactive patch and the bag corners, thereby reducing the chance of the bag sealing in this area. A registration mark 20 can be used to register the microwave interactive pattern to the proper position of the blank and to position any graphics printed onto the paper surface of the blank.

The bag may be formed from a laminate of paper and polymeric film, in which the polymeric film has a patterned metallic layer (of an appropriate thickness to interact with microwave energy) coated on one surface. Upon being laminated, the metallic layer becomes sandwiched between the paper and the polymeric film. A process which converts roll stock of a pre-formed laminate may be used to form the bag, or the bag may be formed in a process which separately inputs paper and patterned metallic polymeric film, laminates the two and forms the bag in a single in-line process. An important element of this embodiment of the invention is the use of separate pattern areas of the fused microwave interactive panels. As described in detail in U.S. application Ser. No. 08/187,446 U.S. Pat. No. 5,412,187 referenced above, the pattern forming the fused metallic microwave interactive layer may be formed in a pattern metallization process or it could be formed in a pattern de-metallization process in which a polymeric film is entirely metalized and areas of the metallic layer are then selectively removed.

Figure 3:
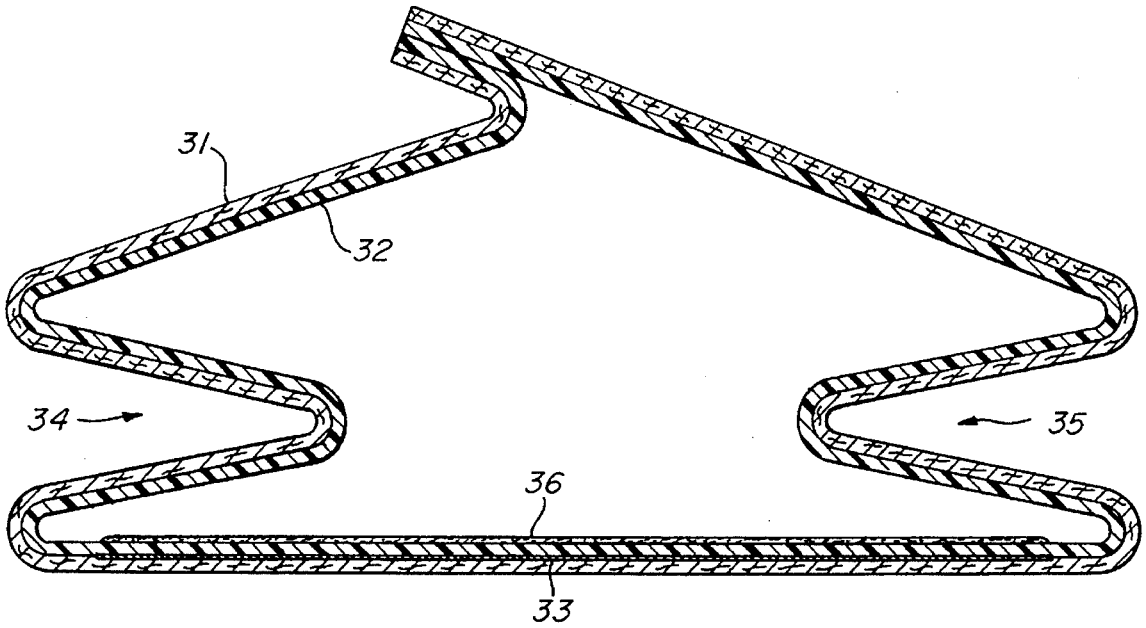
FIG. 3 is a cross-sectional view of a second embodiment of the microwave bag of the present invention.

A second preferred embodiment of the present invention is gusseted, pinched bottom, two-ply bag as shown in FIG. 3. A gusseted bag provides a large volume when expanded while maintaining a small profile when not expanded. This feature is desirable, particularly in applications in which the bag is intended to be transported in a flat condition and expanded in use. As shown in FIG. 3, the gusseted bag is formed of two substrates. The first substrate 31 comprises a paper layer (preferably 25–50 pound paper) and the second substrate 32 comprises a layer of a heat-sealable polymeric film, preferably polyethylene terephthalate (PET). The first 31 and second 32 substrate are laminated together to form a two-ply material from which the bag is formed. A microwave interactive layer 33 is formed on one surface of the polymeric substrate 32 which is preferably positioned to sandwich the microwave interactive layer 33 between the polymeric substrate 32 and the paper substrate 31 when those substrates are laminated together.

FIG. 3 shows a configuration in which the microwave interactive layer 33 extends into the base area below gussets 34 and 35. As such, when the bag is exposed to microwave energy, the film 32 upon which the microwave interactive layer 33 is positioned has the potential to fuse with the film in the portion of the gussets, thereby causing the bag to stick together and preventing expansion. In order to overcome the problem, a silicon coating 36 can be applied to cover an area at least in register with the microwave interactive layer 33. The silicon prevents polymeric film in the area of the gussets from fusing with polymeric film adjacent to the microwave interactive layer and thereby allows the bag to expand as desired.

The silicon coating 36 may be applied using any of a wide variety of techniques known to those skilled in the art. In the preferred embodiment, however, the silicon layer is applied by a printing process in which it is printed directly onto laminated roll-stock used to form the bag.

It should be further noted that the silicon coating 36 is not intended to have applicability only to the gusseted embodiment of the present invention. Rather, a silicon coating may be applied to the interior surface of the bag shown in FIGS. 1 and 2 in order to minimize the possibility of sticking. Likewise, if a silicon coating is used on the interior surface of such bags, the need to eliminate microwave interactive material in the creases of the bag is overcome. Thus, the use of a silicon coating on the interior surface of the bag raises the possibility of forming a bag having a microwave interactive layer forming a susceptor on substantially the entire interior surface of the bag. Such a construction eliminates the need to form separate patches of microwave interactive material and may simplify the manufacturing process.

An alternative to the silicon-coated heat sealable polymeric film in the aforementioned gusseted bag is a non-heat sealable polymeric film. The use of a non-heat sealable polymeric film, however, would require the registered application of an adhesive, i.e., the adhesive would have to be registered to the metallic pattern to provide adherant properties at the end and fin seal areas.

It is well known in the art of food packaging to evacuate a bag containing a perishable food product in order to extend the "shelf-life" of that product. This well known application can be applied in a unique way to microwave cooking to produce superior browning and crisping of food products. In particular, a food product can be inserted into a microwave crisping and browning bag prior to evacuating air from the interior of the bag and heat sealing the open end of the bag to form an enclosed, heat-sealed package. The microwave interactive layer, sandwiched between an outer paper layer and an inner polymeric layer is caused to be in extremely close contact with the entire surface of the food as a result of the vacuum on the interior of the bag, thereby enhancing the crisping and browning of the food surface.

In yet another embodiment, a microwave browning and crisping bag can be formed having a base of one material and a top of a second material. In this embodiment, the bag can be formed by sealing a top blank to a base blank on three sides. The base blank is preferably rectangular and formed from a two-ply paper/heat-sealable film laminate as described above. A patterned microwave interactive layer is deposited on the heat-sealable film. The top blank is preferably also a rectangular, but single ply material comprising a heat-sealable film having a microwave interactive layer deposited on its inner surface. The resulting package, when filled with a food product, evacuated, and sealed will position the microwave interactive layers in close proximity to the entire food surface, in order to provide effective crisping and browning of the food surface.

It should be noted, that in each embodiment above, the microwave interactive layer is intended to include at least one fuse as described in detail in the previously incorporated U.S. application Ser. No. 08/187,446 U.S. Pat. No. 5,412,187. The fused microwave interactive layer is an important element of the invention in that it provides a temperature-regulating function to the food container.

In particular, and as described in greater detail in the referenced application, the fused microwave interactive layer acts as a microwave susceptor which heats when subjected to microwave energy. If the microwave interactive layer is heated above a predetermined temperature range, a temperature sensitive fuse-link is caused to fail, thereby altering the microwave interactive properties of the microwave interactive material and reducing the amount of heating resulting from exposure of that material to the microwave energy field. However, in areas of the microwave interactive layers that are in contact with, or in close proximity to, a food product, the food product acts as a heat sink to draw heat away from the microwave interactive material. In so doing, the microwave interactive material never reaches a temperature sufficient to cause failure of the temperature sensitive fuse link, but rather is allowed to maintain a temperature sufficient to crisp and brown the adjacent food surface.

As a result of the temperature-sensitive fuses, the microwave interactive material acts as a microwave susceptor, heating only in those areas which are in contact with or in close proximity to a food product. The other areas of the microwave interactive material rapidly undergo failure of their respective fuse links, thereby rendering them incapable of heating to a degree in which scorching or other undesirable heating of the food container can occur.

It should be understood that the foregoing description of the invention is intended merely to be illustrative thereof, that the illustrative embodiments are presented by way of example only, and that other modifications, embodiments, and equivalents may be apparent to those skilled in the art without departing from its spirit.

Having thus describing the invention, what we desire to claim and secure by Letters Patent is:

1. A bag for heating a food product in a microwave oven, the bag comprising:

a) a dielectric substrate; and b) a polymeric substrate having a plurality of microwave interactive patches thereon, at least one microwave interactive patch being patterned to include at least one temperature sensitive fuse, the dielectric substrate and the polymeric substrate being laminated together to form a laminated body, wherein the microwave interactive patches are positioned between the dielectric substrate and the polymeric substrate, and further wherein the laminated body is folded to form a bag having microwave interactive patches spaced from any creases or seams formed in the bag.

2. The bag as in claim 1 wherein the dielectric substrate comprises paper.

3. The bag as in claim 1 wherein the polymeric substrate comprises a polyethylene terephthalate film.

4. The bag as in claim 1 wherein the microwave interactive patches comprise aluminum.

5. The bag as in claim 1 wherein the polymeric substrate is heat sealable.

6. The bag as in claim 1 wherein at least one of the microwave interactive patches has at least one radiused corner.

7. The bag as in claim 1 which further includes a silicon coating provided on a surface of the polymeric substrate, the coating corresponding at least in size and position to at least one microwave interactive patch.

8. The bag as in claim 7 wherein the silicon coating covers substantially the entire polymeric substrate.

9. The bag as in claim 1 which is constructed and arranged to be evacuated and sealed once a food product is contained therein.

10. A bag for heating a food product in a microwave oven, the bag comprising:

a) a base portion, b) a top left portion, and c) a top right portion, wherein the top left portion and the top right portion are joined together by a fin seal and each of the top left portion and top right portion is joined to the base portion by an end seal and at least one crease, and further wherein each of the base portion, the top left portion and the top right portion includes a microwave interactive patch, at least one such microwave interactive patch being patterned to include at least one temperature sensitive fuse, the microwave interactive patches being spaced from the fin seal, each end seal and each crease.

11. The bag as in claim 10 wherein the microwave interactive patches are positioned on a polymeric substrate.

12. The bag as in claim 11 wherein the polymeric substrate comprises a polyethylene terephthalate film.

13. The bag as in claim 11 wherein the polymeric substrate is heat sealable.

14. The bag as in claim 10 wherein the microwave interactive patches comprise aluminum.

15. The bag as in claim 10 wherein at least one of the microwave interactive patches has at least one radiused corner.

16. The bag as in claim 10 which further includes a silicon coating deposited on at least one of the base portion, the top left portion, and the top right portion and further corresponds in size and position to the microwave interactive patch in that respective portion.

17. The bag as in claim 16 wherein the silicon coating covers substantially the entire base portion, top left portion and top right portion.

18. The bag as in claim 10 which is constructed and arranged to be evacuated and sealed once a food product is contained therein.

19. A blank for forming a bag for heating a food product in a microwave oven comprising:

a) a base portion, b) a top left portion, and c) a top right portion, wherein the top left portion and the top right portion each include a fin seal area allowing them to be joined to one another, the top left portion and the base portion each include an end seal area allowing them to be joined to one another, and the top right portion and the base portion each include an end seal area allowing them to be joined to one another, each of the top left portion and the top right portion being folded over at least a portion of the base portion along at least one crease, the blank further including a plurality of microwave interactive patches, one such patch being positioned at each of the base portion, the top left portion and the top right portion, at least one such microwave interactive patch being patterned to include at least one temperature sensitive fuse, the microwave interactive patches being spaced from the fin seal areas, each end seal area and each crease.

20. The blank of claim 19 wherein the microwave interactive patches are formed on a polymeric substrate.

21. The blank of claim 20 wherein the polymeric substrate is laminated to each of the base portion, top left portion and top right portion.

22. The blank of claim 21 wherein the laminated polymeric substrate is positioned such that each microwave interactive patch is positioned between the substrate and each of the base portion, top left portion and top right portion.

23. The blank as in claim 20 wherein the polymeric substrate comprises a polyethylene terephthalate film.

24. The blank as in claim 20 wherein the polymeric substrate is heat sealable.

25. The blank as in claim 19 wherein the microwave interactive patches comprise aluminum.

26. The blank as in claim 19 wherein at least one of the microwave interactive patches has at least one radiused corner.

27. The blank as in claim 19 which further comprises a silicon coating corresponding in size and location to at least one of the microwave interactive patches positioned at the base portion, the top left portion, or the top right portion.

28. The blank as in claim 27 wherein the silicon coating covers substantially the entire surface of the base portion, the top left portion and the top right portion.

29. Roll stock for forming bags useful for heating a food product in a microwave oven comprising:

a plurality of blanks on a web, each blank comprising:

a) a base portion, b) a top left portion, and c) a top right portion, wherein the top left portion and the top right portion each include a fin seal area allowing them to be joined to one another, the top left portion and the base portion each include an end seal allowing them to be joined to one another, and the top right portion and the base portion each include an end seal area allowing them to be joined to one another, each of the top left portion and the top right portion being folded over at least a portion of the base portion along at least one crease, each blank further including a plurality of microwave interactive patches, one such patch being positioned at each of the base portion, the top left portion and the top right portion, at least one such microwave interactive patch being patterned to include at least one temperature sensitive fuse, the microwave interactive patches being spaced from the thin seal areas, each end seal area and each crease.

30. A bag for heating a food product in a microwave oven, the bag comprising:

a) a dielectric substrate; and b) a polymeric substrate having at least one microwave interactive patch thereon, said at least one microwave interactive patch being patterned to include at least one temperature sensitive fuse, the dielectric substrate and the polymeric substrate being laminated together to form a laminated body, wherein said at least one microwave interactive patch is positioned between the dielectric substrate and the polymeric substrate.

31. The bag as in claim 30 which further includes a silicon coating on the opposite side of the polymer substrate from which said at least one microwave interactive patch is positioned, the silicon coating corresponding at least in size and position to said at least one microwave interactive patch.

32. The bag as in claim 31 wherein the silicon coating covers substantially the entire surface of the polymeric substrate.

33. A bag for heating a food product in a microwave oven which comprises:

a) a base layer which comprises i) a dielectric substrate; and ii) a first polymeric substrate having at least one microwave interactive patch thereon, the dielectric substrate and the first polymeric substrate being laminated together to form a laminated body, wherein said at least one microwave interactive patch is positioned between the dielectric material and the first polymeric substrate, and b) a top layer which comprises a second polymeric substrate having at least one microwave interactive package thereon, the first and second polymeric substrates capable of being heat sealed to one another to form a food container which may be evacuated, wherein at least one of said microwave interactive patches on at least one of the first polymeric substrate and the second polymeric substrate is patterned to include at least one temperature sensitive fuse, and further wherein the bag is constructed and arranged to be evacuated and sealed once a food product is contained therein.

* * * * *